US007438247B2

(12) United States Patent
Leclercq

(10) Patent No.: US 7,438,247 B2
(45) Date of Patent: Oct. 21, 2008

(54) GRINDING ROLLERS FOR A VERTICAL CRUSHER

(75) Inventor: Léon Leclercq, Embourg (BE)

(73) Assignee: Magotteaux International SA (BE)

( * ) Notice: Subject to any disclaimer, the term of this patent is extended or adjusted under 35 U.S.C. 154(b) by 88 days.

(21) Appl. No.: 10/591,030

(22) PCT Filed: Dec. 20, 2004

(86) PCT No.: PCT/BE2004/000179

§ 371 (c)(1),
(2), (4) Date: Aug. 29, 2006

(87) PCT Pub. No.: WO2005/084809

PCT Pub. Date: Sep. 15, 2005

(65) Prior Publication Data

US 2007/0184235 A1 Aug. 9, 2007

(30) Foreign Application Priority Data

Mar. 3, 2004 (EP) ..... 04447053

(51) Int. Cl.
*B02C 15/00* (2006.01)

(52) U.S. Cl. ..... 241/293; 241/117; 241/294

(58) Field of Classification Search ..... 241/117–121, 241/293–295, 300

See application file for complete search history.

(56) References Cited

U.S. PATENT DOCUMENTS

| | | | |
|---|---|---|---|
| 5,000,392 | A | 3/1991 | Kästingschäfer et al. |
| 5,328,776 | A | 7/1994 | Garber et al. |
| 6,399,176 | B1 | 6/2002 | Francois |

FOREIGN PATENT DOCUMENTS

| | | |
|---|---|---|
| DE | 44 00 797 | 7/1995 |
| EP | 0 476 496 | 1/1995 |
| EP | 0 930 948 | 8/2000 |
| JP | 2001 129418 | 5/2001 |

OTHER PUBLICATIONS

International Preliminary Report on Patentability (translation), International Application No. PCT/BE2004/000179, date of actual completion of the corresponding international search Apr. 11, 2005, date of actual mailing of the corresponding international search report Apr. 21, 2005, 4 pages, European Patent Office.

*Primary Examiner*—Mark Rosenbaum
(74) *Attorney, Agent, or Firm*—Reinhart Boerner Van Deuren P.C.

(57) ABSTRACT

The invention relates to a composite milling roller, produced by casting, comprising peripheral inserts of a high wear-resistance and high hardness material, sealed in a ductile material on said casting. The roller comprises first zones subject to high wear and second zones subject to low wear, characterised in that said first zone of said roller comprises inserts on the peripheral face thereof with adjoining parts and, in said second zone, a non-adjoining part. The gap between the non-adjoining parts is filled with said ductile material of the cast matrix permitting an adequate mechanical anchoring of the inserts.

20 Claims, 6 Drawing Sheets

GRINDING ROLLERS FOR A VERTICAL CRUSHER

CROSS-REFERENCE TO RELATED PATENT APPLICATION

This patent application is the National Stage of International Application No. PCT/BE2004/000179 filed Dec. 20, 2004, which claims the benefit of EP 04447053.2 filed Mar. 3, 2004, the teachings and disclosure of which are hereby incorporated in their entireties by reference thereto.

FIELD OF THE INVENTION

The present invention aims to provide improvements to grinding rollers for crushers in general, and for "vertical axis" crushers in particular.

TECHNOLOGICAL BACKGROUND AT THE BASIS OF THE INVENTION

"Vertical axis" crushers are used for instance for crushing coal or clinker. They are essentially made of a rotating track supporting rollers that are driven by the rotary motion of the track along the vertical axis. The material to be crushed is fed into a central supply channel and falls onto the track, where it is crushed and ground between the track and the rollers. The ground material is then retrieved from the periphery of the track.

Various types of roller shapes are possible, such as tapered or toric rollers. Document DE 44 00 797 A1 describes rollers of this shape where the wear parts are mechanically sealed by a mechanical fixation means.

Document JP 2001 129418 describes a mechanical crusher with wear parts provided at the outer surfaces of the rollers, that allow their easy replacement when grooves are showing signs of wear. These wear parts are inserted into a core in the form of an inverted T so that they perfectly adhere to the whole surface of the protrusions.

The techniques used in the German and Japanese documents do not use the technology of casting the protrusions. The techniques used in the German and Japanese documents do not use the casting technology of pouring a more ductile material around inserts allowing to fix the latter in the remaining mass of the roller.

Specific forms of vertical axis crushers are shown in FIGS. 1 and 2. This subject is described in more detail in patent EP 0 476 496 B1.

This patent describes among other things a particular configuration of the grinding rollers whose characteristic feature is that the wear surface is essentially made up of peripheral inserts in very hard materials with high wear resistance (such as cast iron with a high chromium level), mechanically sealed in a matrix of a ductile material.

In this version, the inserts are produced in advance with a protruding rib on at least one longitudinal side and are then placed side by side in a mould, leaving between them a space defined by the thickness of their ribs. The roller is produced in the form of a bimetallic part by a casting technique by pouring a more ductile material that ensures the mechanical connection of the inserts in the remaining mass of the roller formed by the ductile material.

The peripheral inserts thus being spaced by ribs relative to each other, the ductile material, during the manufacture of the roller by casting, may infiltrate between the inserts until the peripheral wear surface itself, thus ensuring that the inserts are well fixed in the parts. This arrangement leads to a succession of hard inserts that are essentially separated by a gap in a more ductile material (with the exception being the spacing ribs).

In order for the ductile metal to be able to continuously infiltrate between the inserts, the gap created between the inserts when they are positioned in the mould should progressively increase from the periphery towards the middle in such a way that the molten metal does not coagulate upon contact with the cold inserts, thereby preventing the complete filling of this gap with the ductile metal. However, due to the wear of the part in use, this arrangement changes, creating at the periphery a wider and wider ductile gap, resulting of the slope of the sides of this gap. This nevertheless causes the unfortunate effect of reducing the hard peripheral surface of the inserts and, as a result, of accelerating the wear of the part.

Moreover, in the case of grinding rollers, localised preferential wear is observed, generally on the outer edges of the roller. This wear affects the useful life of the rollers but also the quality of the ground product as well as the grinding yield since the support surface of the roller on the track is reduced and this is even more so since the track itself is subjected to wear in operation.

In the case where, according to a recent technical development, the inserts contain internal reinforcement of ceramic materials in order to reduce wear, the presence of an unprotected gap between the inserts means that in operation, a groove is created between the inserts, thereby detaching the ceramic reinforcement and chipping its edges. This phenomenon greatly reduces the efficiency of the ceramic reinforcement since it then produces very abrasive materials in addition to the fact that its potential wear resistance diminishes with its size.

In the above-mentioned patent, there is also a description (in relation to FIGS. 5 to 9) of an embodiment of a collar that compensates for the wear profile according to the generatrix.

To do this, the inserts do not extend in their longitudinal direction along the entire length of the generatrix so that they leave, on the outer edge of the rollers, a peripheral lug belonging to the support of ductile cast iron, making up the rest of the roller.

More rapid wear is thereby deliberately caused in this area of the roller in order to compensate for the fact that this area normally wears less rapidly. However, this method has the drawback that the wear on the lug of ductile cast iron exposes the end of the insert to chipping similar to that described above regarding the longitudinal edges of the insert, with the same detrimental consequences.

AIM OF THE INVENTION

The aim of the present invention is to provide a new form of insert so as to avoid the drawbacks of the solutions of the state of the art.

CHARACTERISTIC ELEMENTS OF THE INVENTION

The present invention discloses a composite grinding roller, produced by casting, having peripheral inserts in a material with high wear resistance and great hardness, sealed during said casting in a ductile matrix, said ductile matrix infiltrating around or in the peripheral insert during this casting in such a way as to form a close contact at the interface between said peripheral inserts and said ductile matrix, said roller having both first zones subjected to heavy wear and second zones subjected to light wear wherein said first zone comprises on its peripheral face inserts with an abutted part and said second zone has a part that is not abutted, the gap in said part that is not abutted being filled with said ductile material during casting, allowing sufficient mechanical fixation of the inserts.

In a preferred embodiment of the invention, the abutted faces coming into contact with their neighbours in successive inserts have a contact line corresponding to the radii of the circle formed by the roller.

According to the present invention, the ratio of the lengths of the abutted faces to the lengths of the zones where the faces do not abut is greater than or equal to 0.2.

In general, the invention specifies that the ratio between the lengths of the zones where the faces abut to the lengths of the zones where the faces do not abut is between 0.2 and 20.

In an especially preferred embodiment of the invention, the wear resistance of the inserts, in particular in the abutting parts, is increased by a ceramic reinforcement selected from the group of oxides, carbides, nitrides or borides.

Still according to the invention, said insert comprises at least one undercut allowing its sealing into said matrix cast in ductile material.

BRIEF DESCRIPTION OF THE FIGURES

FIGS. 10 and 11 correspond to FIGS. 8 and 9 respectively in the case where the inserts comprise ceramic reinforcements (shown by dots).

Identical reference numbers are used in the various figures for identical or essentially similar constituent elements, both for the description of the state of the art and for the embodiment as in the invention.

In FIGS. 3 and 4 that show embodiments as in the state of the art, the common reference number 1 indicates a roller having inserts 5 which, as a result of the presence of the ribs 20 during the formation of the roller by casting, are longitudinally spaced, the ribs 20 serving as spacers.

Figure 3:
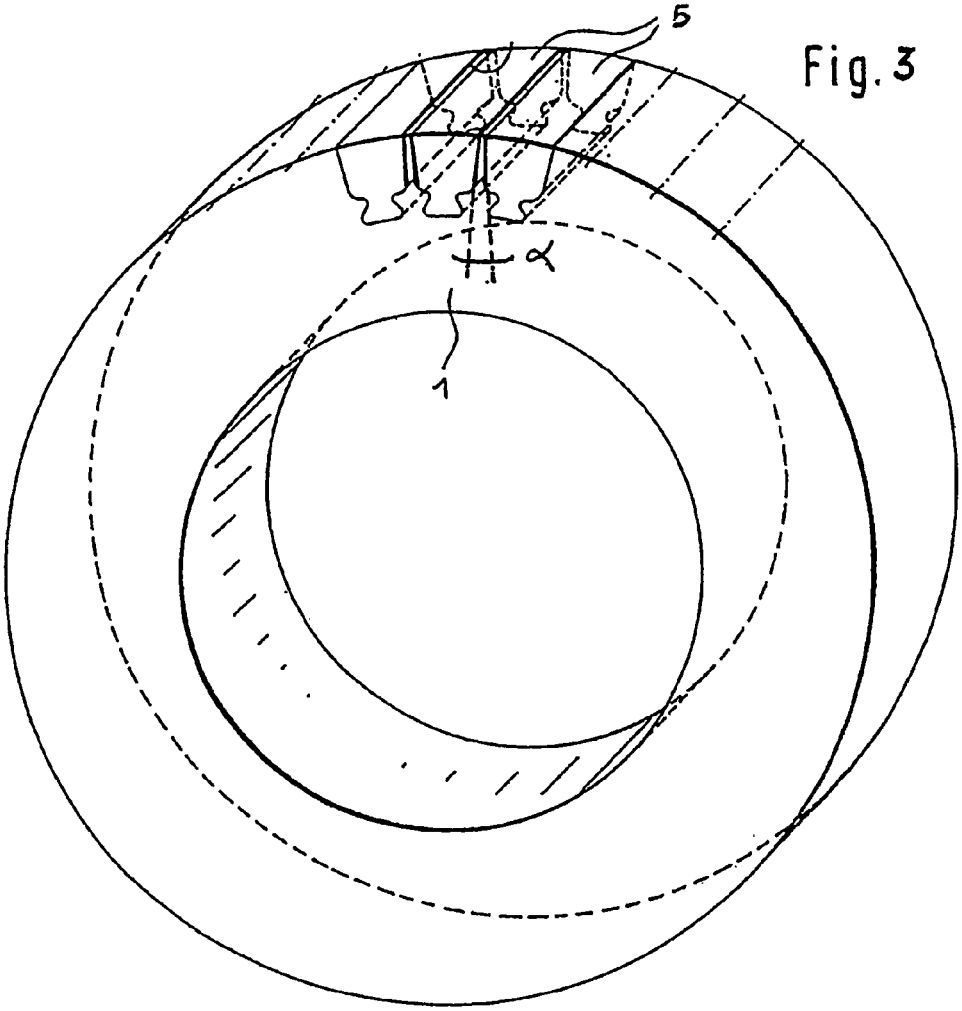
FIG. 3 schematically shows in perspective a roller as in the state of the art for which are shown a certain number of spaced inserts extending longitudinally over the whole length of the roller's generatrix.
Figure 4:
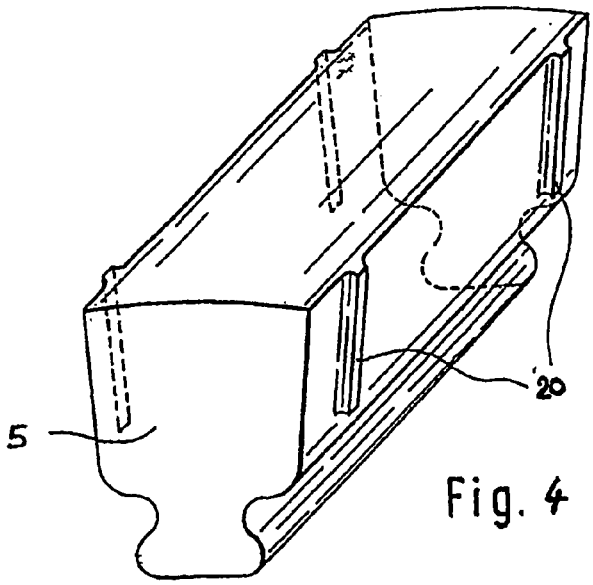
FIG. 4 shows the insert as in the state of the art, showing the spacing ribs 20 that were not shown in FIG. 3.

As indicated above, in order to allow the passage of the ductile metal 19 intended to globally form the remaining part of the roller 1 between the inserts through to the wear surfaces themselves during the casting of the roller, progressive spacing is provided between the inserts at an angle $\alpha$ from the periphery towards the axis of the roller (see FIG. 3).

Figure 1:
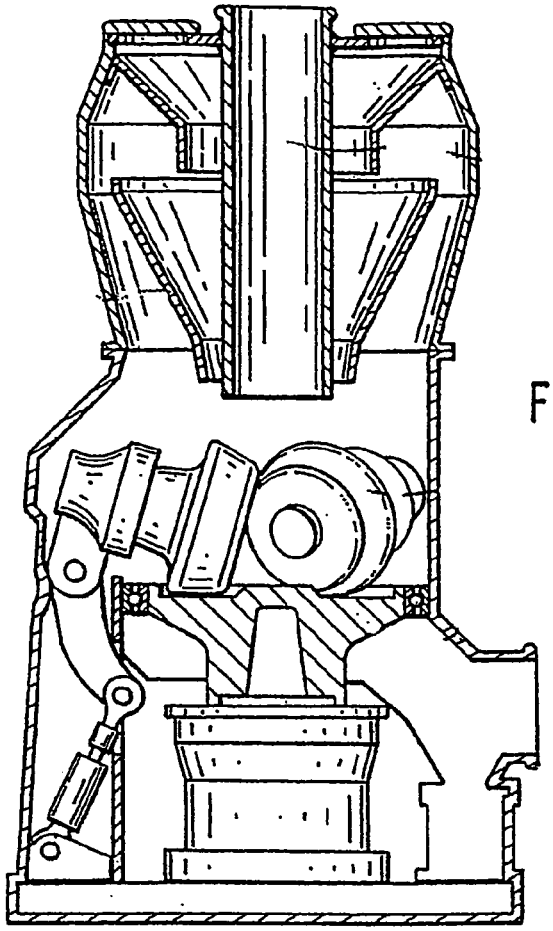
FIG. 1 schematically shows a "vertical axis" crusher.
Figure 2:
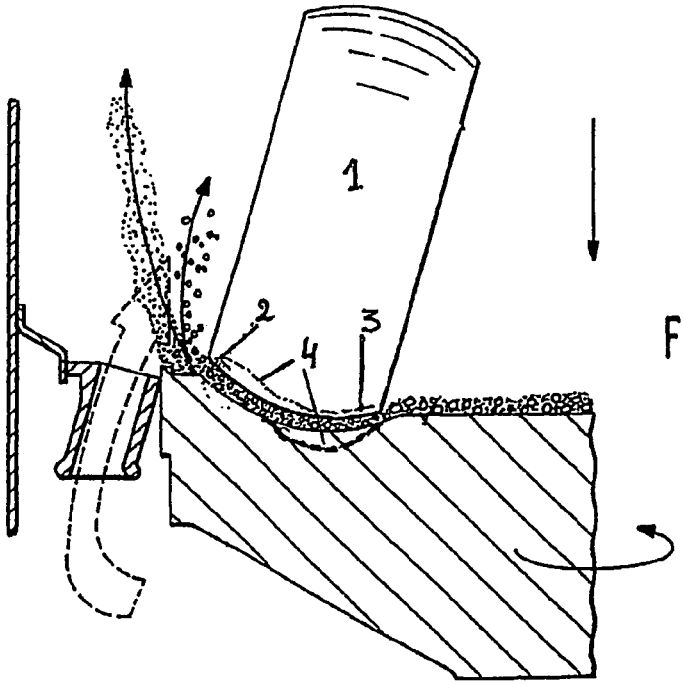
FIG. 2 shows the grinding mechanism acting between the track and the roller 1 with zones of heavier wear 2 and 4 and zones of lighter wear 3. The wear that may occur on the track is also shown.

It can be seen in operation that, as a result of differential wear, the gap between the roller and the table in the longitudinal direction is no longer constant, which greatly reduces the grinding efficiency, especially as the table itself may be subjected to wear. This is shown in FIG. 2. Moreover, the wear on the rollers becomes heavier as the peripheral surface of the insert is reduced by the existence of grooves of increasing width that are created in operation between the hard inserts.

Figure 5:
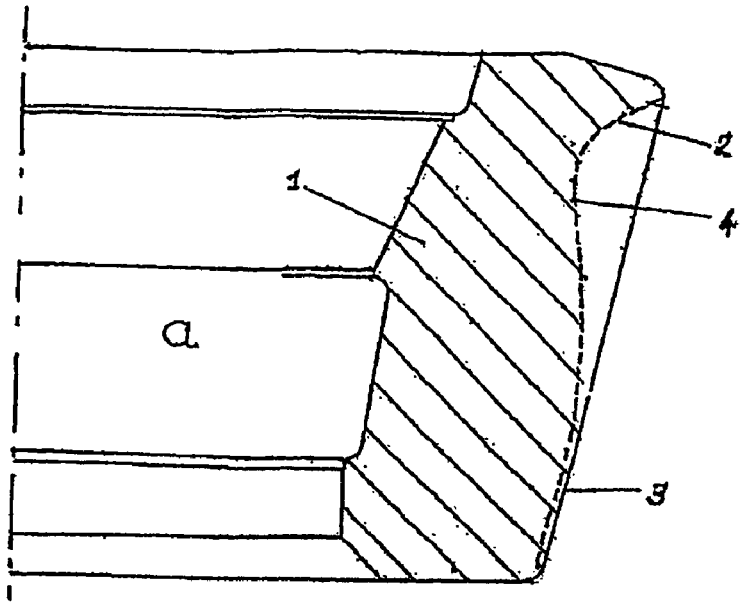
FIG. 5 shows an example of wear profiles observed on two types of rollers a and b as in the state of the art.
Figure 5:
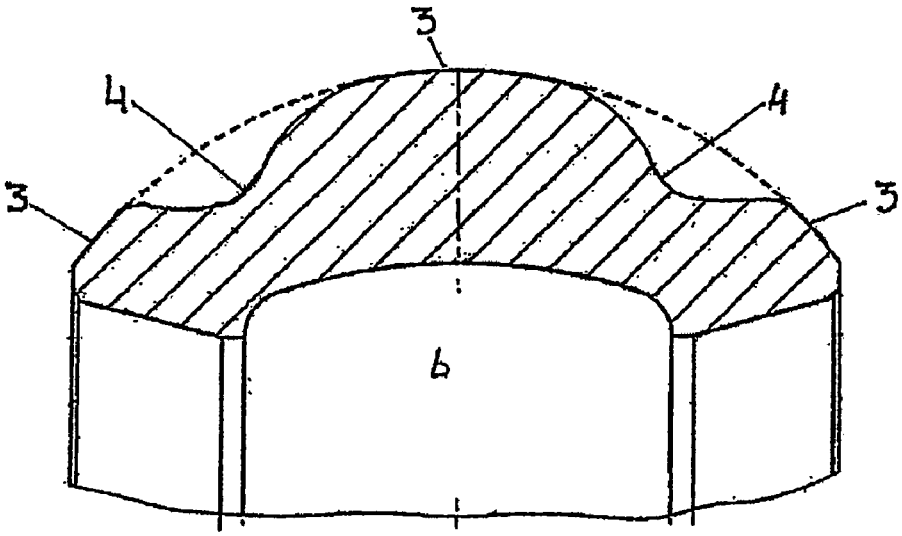

Depending on the shape of the roller, whether tapered or toric, and on the type of crusher, a wear profile 4 can be seen as shown in FIG. 5, varying for instance between one or two zones with heavy wear 2 and 4 and a zone with lighter wear 3.

In order to increase the wear resistance of the inserts 5, in particular on their outer parts 14, reinforcement may be provided there by infiltrating a porous ceramic core: oxides, carbides, nitrides, borides or other substances as described for example in patent EP 0 930 948 B1 or by creating a ceramic structure in situ.

Figure 6:
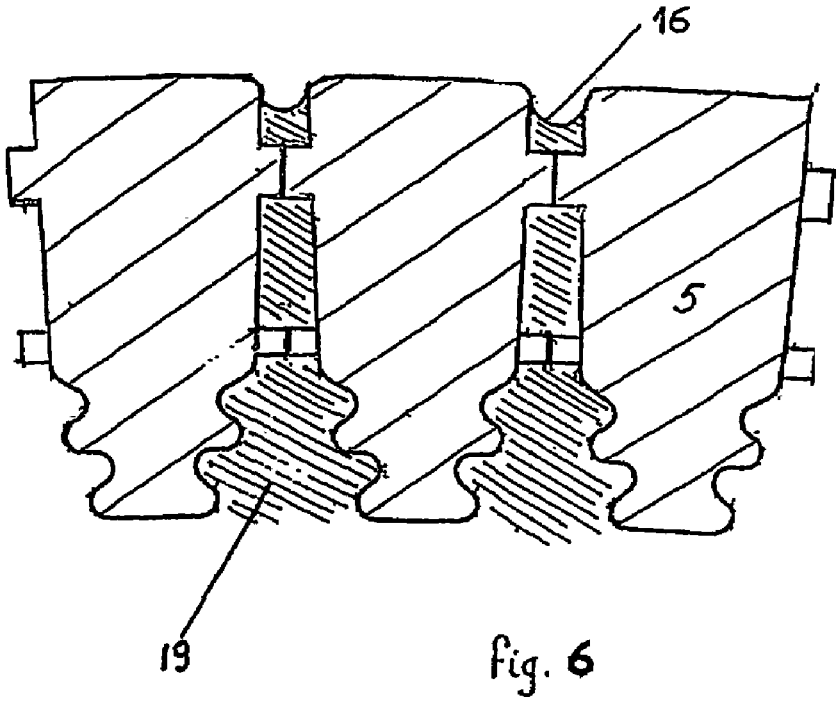
FIG. 6 shows the formation of wear grooves 16 in the inserts as in the state of the art.
Figure 7:
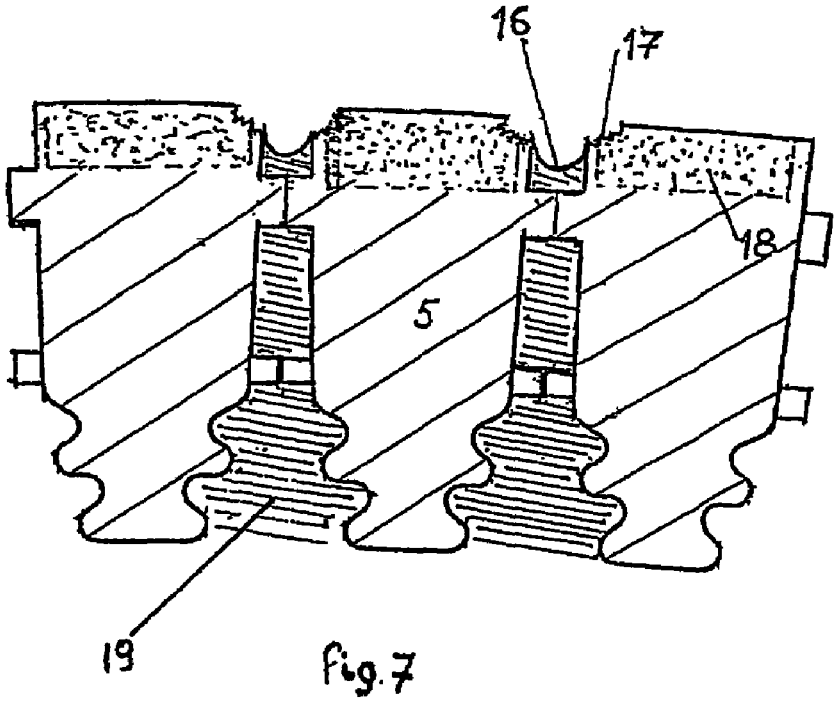
FIG. 7 shows the flaking-off of the edges of the ceramic reinforcements 17 and 18 of the inserts resulting from the formation of grooves shown in FIG. 6.

In the case of the use of a composite with a ceramic reinforcement, the formation of grooves of increasing size resulting from wear 16 in operation would present an important drawback because these grooves detach the ceramic contained in the insert (FIG. 6) which, under the effect of impacts and pressure, chips at the edges (FIG. 7). This considerably increases wear and destroys to a great extent the point of this ceramic reinforcement.

FIG. 6 shows the formation of grooves 16 according to the former design, with inserts 5 without ceramic reinforcement.

FIG. 7 shows what happens in operation when a ceramic reinforcement 18 is incorporated into the inserts 5. It is observed that after the formation of grooves 16 in the ductile metal, the ridges 17 of the infiltrated ceramic mass 18 break, releasing very abrasive materials and accelerating the formation of the irregular wear profile.

Given these experimental data, the inserts are designed as in the invention in such a way as to create a differential wear resistance between the parts subjected to heavy wear 2 and 4 and the parts subjected to lighter wear 3.

Figure 8:
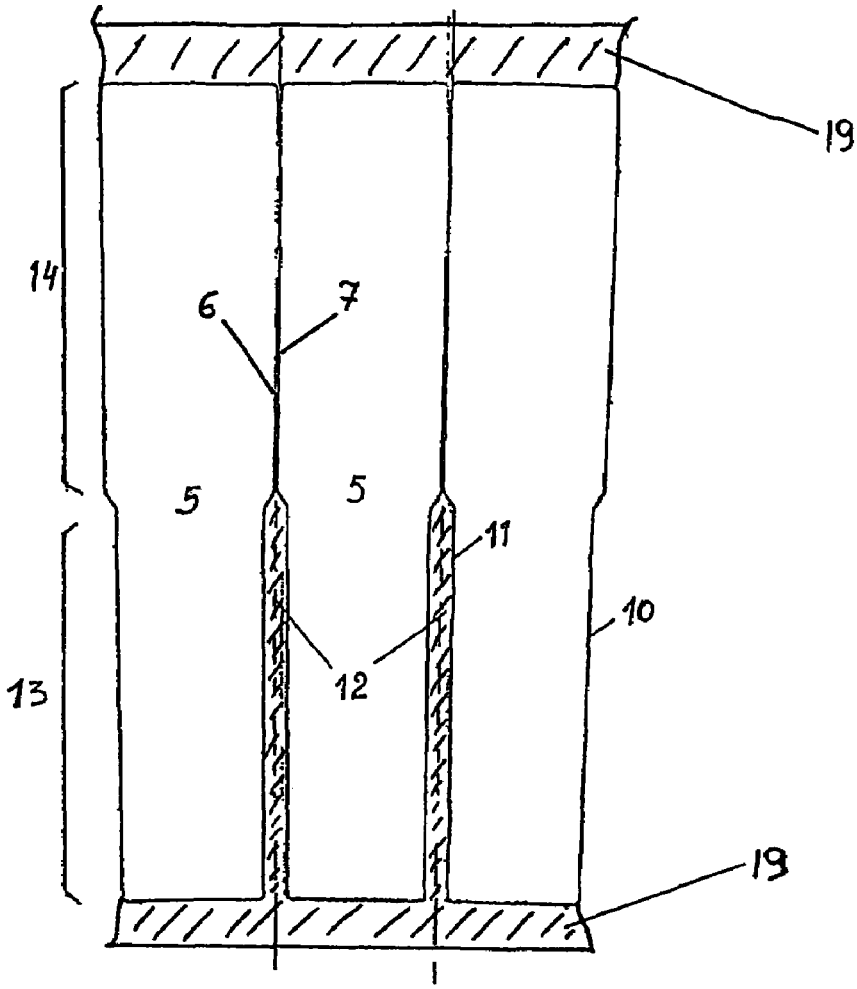
FIG. 8 is a view of a set of inserts juxtaposed as in the invention.

According to the invention, this effect is obtained by using inserts 5 (see FIGS. 8 and following) that abut in the above-mentioned part subjected to heavy wear 2 and that maintain the gaps 12 in the part subjected to lighter wear 3 that are filled by a cast ductile metal 19. A zone with high wear resistance 14 and a zone with lower wear resistance 13 are thus obtained. The faces 6 and 7 that come into contact with their neighbours in the successive inserts (see FIGS. 8 and 10) are aligned on the centre of the roller, i.e. their line of contact in section corresponds to the radii of the circle formed by the roller. This ensures perfect contact between the inserts 5 when they are placed next to each other, whereas the recessed surfaces 10 and 11 define the spacing between the inserts, thus creating a zone that is less resistant to wear 13 on the inner part of the roller, whilst the most exposed surface 14 will be continuous, without the risk of grooves occurring and, as a result, without the risk of a reduction in wear resistance.

The relative position of the zone(s) subjected to heavy wear compared to the position of one of the zones subjected to light wear will depend on the type of crusher and on the type of roller and, more particularly, on its geometrical form.

The ratio of the width of the zone(s) heavily exposed to wear to the width of the zone(s) lightly exposed to wear is usually greater than or equal to one. Ratios between the respective widths of these same zones of 1 to 1.5 allow both the provision for a sufficient grinding area and suitable fixation of the inserts in the matrix.

The fact that the inner part 3 of the insert retains the ability to form grooves is beneficial in itself in the sense that it thus ensures better drive of the roller by reducing the sliding or skidding effect over the material to be ground.

Figure 9:
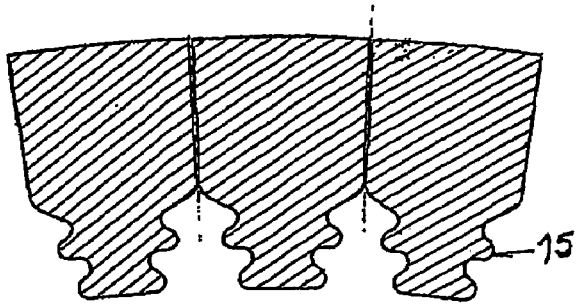
FIG. 9 is a sectional view of an insert in zone 14, as in FIG. 8.

The fixation of the inserts in the matrix is mechanically ensured and this essentially by means of the shape of the lower part 15 of the insert, as shown in FIG. 9.

This shape is selected so as to allow a strong undercut of a dovetail type, a hole or another fixation means.

Figure 10:
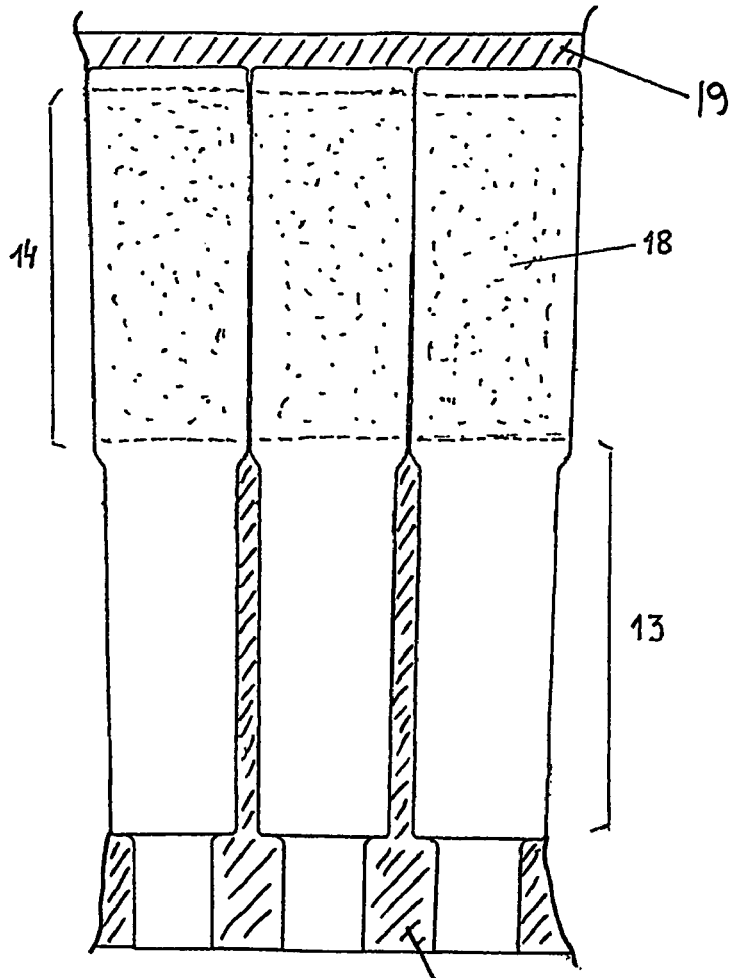
FIG. 10 is a plan view of the partially abutted arrangement of three inserts as in the invention.
Figure 11:
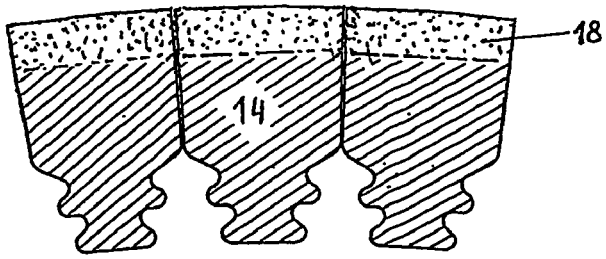
FIG. 11 is a sectional view of an insert as in FIG. 10.

FIGS. 10 and 11 show the continuity according to the invention of the ceramic reinforcements 18 in the outer part 14 of the wear surface of the inserts made up of the two parts 13 and 14, which eliminates the fragile ridges and, as a result, the loss of material intended to resist wear.

KEY

1 Grinding roller with inserts
2 & 4 Zone subjected to heavy wear
3 Zone subjected to light wear
5 Peripheral inserts
6 Abutting surfaces in the zone with high wear
& 7 resistance
10 Recessed or non-abutting surfaces in the zone of lower
& 11 wear resistance
12 Gaps in the part with lower wear resistance
13 Zone subjected to the lowest level of wear
14 Outer part of the inserts subjected to the highest level of wear
15 Undercut in the lower part of the insert
16 Wear groove in operation
17 Sharp ridges of the ceramic reinforcement
18 Ceramic reinforcement of the insert
19 Ductile material
20 Spacing ribs

The invention claimed is:

1. A composite grinding roller (1), produced by casting, comprising peripheral inserts (5) made of a material with high wear resistance and great hardness, sealed during said casting in a ductile matrix (19), said ductile matrix (19) infiltrating around or into the peripheral inserts(5) during this casting in such a way as to establish close contact at the interface between said peripheral inserts (5) and said ductile matrix (19), said roller (1) comprising first zones subjected to heavy wear (14) as well as second zones subjected to light wear (13), wherein said first zones (14) have, on its peripheral surface, the peripheral inserts (5) with an abutting part (6,7) and said second zones (13) have a non-abutting part, the gap in said non-abutting part (12) being filled by said ductile material (19) during the casting, allowing sufficient mechanical fixation for the peripheral inserts.

2. The roller as in claim 1, wherein abutting surfaces of the abutting part (6) and (7) of successive peripheral inserts form a contact corresponding to the radii of the circle formed by the roller (1).

3. The roller as in claim 2, wherein a ratio of the lengths of the first zones to the lengths of the second zones is greater than or equal to 0.2.

4. The roller as in claim 3, wherein a wear resistance of the peripheral inserts (5), in the abutting part, is increased by a ceramic reinforcement selected from the group of oxides, carbides, nitrides or borides.

5. The roller as in claim 4, wherein said peripheral inserts (5) comprises at least one undercut (15) that allows its sealing into said matrix cast in ductile material (19).

6. The roller as in claim 3, wherein said peripheral inserts (5) comprises at least one undercut (15) that allows its sealing into said matrix cast in ductile material (19).

7. The roller as in claim 2, wherein a wear resistance of the peripheral inserts (5), in the abutting part, is increased by a ceramic reinforcement selected from the group of oxides, carbides, nitrides or borides.

8. The roller as in claim 7, wherein said peripheral inserts (5) comprises at least one undercut (15) that allows its sealing into said matrix cast in ductile material (19).

9. The roller as in claim 2, wherein said peripheral inserts (5) comprises at least one undercut (15) that allows its sealing into said matrix cast in ductile material (19).

10. The roller as in claim 1, wherein a ratio of the lengths of the first zones to the lengths of the second zones is greater than or equal to 0.2.

11. The roller as in claim 10, wherein a wear resistance of the peripheral inserts (5), in the abutting part, is increased by a ceramic reinforcement selected from the group of oxides, carbides, nitrides or borides.

12. The roller as in claim 11, wherein said peripheral inserts (5) comprises at least one undercut (15) that allows its sealing into said matrix cast in ductile material (19).

13. The roller as in claim 10, wherein said peripheral inserts (5) comprises at least one undercut (15) that allows its sealing into said matrix cast in ductile material (19).

14. The roller as in claim 10, wherein a ratio between the lengths of the first zones to the lengths of the second zones is between 0.2 and 20.

15. The roller as in claim 14, wherein a wear resistance of the peripheral inserts (5), in the abutting part, is increased by a ceramic reinforcement selected from the group of oxides, carbides, nitrides or borides.

16. The roller as in claim 15, wherein said peripheral inserts (5) comprises at least one undercut (15) that allows its sealing into said matrix cast in ductile material (19).

17. The roller as in claim 14, wherein said peripheral inserts (5) comprises at least one undercut (15) that allows its sealing into said matrix cast in ductile material (19).

18. The roller as in claim 1, wherein a wear resistance of the peripheral inserts (5), in the abutting part, is increased by a ceramic reinforcement selected from the group of oxides, carbides, nitrides or borides.

19. The roller as in claim 18, wherein said peripheral inserts (5) comprises at least one undercut (15) that allows its sealing into said matrix cast in ductile material (19).

20. The roller as in claim 1, wherein said peripheral inserts (5) comprises at least one undercut (15) that allows its sealing into said matrix cast in ductile material (19).

* * * * *